US008499949B2

(12) United States Patent
Lahusen

(10) Patent No.: US 8,499,949 B2
(45) Date of Patent: Aug. 6, 2013

(54) COLOR CODING LOCK

(75) Inventor: Eric Paul Lahusen, Thalwil (CH)

(73) Assignee: PI Investment AG, Zurich (CH)

( * ) Notice: Subject to any disclaimer, the term of this patent is extended or adjusted under 35 U.S.C. 154(b) by 1237 days.

(21) Appl. No.: 10/568,828

(22) PCT Filed: Aug. 19, 2004

(86) PCT No.: PCT/EP2004/009311
§ 371 (c)(1),
(2), (4) Date: Sep. 15, 2006

(87) PCT Pub. No.: WO2005/021399
PCT Pub. Date: Mar. 10, 2005

(65) Prior Publication Data

US 2007/0158958 A1 Jul. 12, 2007

(30) Foreign Application Priority Data

Aug. 22, 2003 (DE) ..... 103 38 680

(51) Int. Cl.
*B65D 51/00* (2006.01)

(52) U.S. Cl.
USPC ..... 215/230; 215/228; 220/377; 116/279

(58) Field of Classification Search
USPC ..... 215/228, 230; 116/279; 220/377
See application file for complete search history.

(56) References Cited

U.S. PATENT DOCUMENTS

| | | | | |
|---|---|---|---|---|
| 2,201,205 | A | 5/1940 | Samburg | |
| 2,201,791 | A | 5/1940 | Samburg | |
| 3,073,468 | A | 1/1963 | Arneson | |
| 4,446,979 | A | 5/1984 | Gach et al. | |
| 4,588,098 | A | 5/1986 | Uzdy | |
| 4,674,641 | A | 6/1987 | Rusinyak | |
| 4,723,673 | A * | 2/1988 | Tartaglia et al. | 215/230 |
| 4,747,497 | A * | 5/1988 | Holman | 215/230 |
| 4,793,500 | A * | 12/1988 | Harding | 215/230 |
| 5,035,341 | A | 7/1991 | Heilman et al. | |
| 5,092,477 | A * | 3/1992 | Johnson et al. | 215/230 |
| 5,188,251 | A * | 2/1993 | Kusz | 215/220 |
| 5,265,744 | A * | 11/1993 | Duty et al. | 215/220 |

FOREIGN PATENT DOCUMENTS

WO WO 2006117505 A1 * 11/2006

* cited by examiner

*Primary Examiner* — Anthony Stashick
*Assistant Examiner* — James N Smalley
(74) *Attorney, Agent, or Firm* — Greer, Burns & Crain, Ltd.

(57) ABSTRACT

A locking device having at least one first segment, at least one second segment situated so as to be capable of being moved relative to the first segment, at least one first segment and at least one second segment being capable of assuming at least one first and at least one second position relative to one another, and at least one segment having at least one indicator area that can be substantially permanently modified in at least one physically perceivable property, wherein a movement that is required in order to open and/or close the locking device immediately moves the position of at least one first segment relative to at least one second segment at least temporarily from the first position into the second position, and effects the modification of the physically perceivable property.

22 Claims, 3 Drawing Sheets

COLOR CODING LOCK

BACKGROUND

The present invention relates to a locking device having a control device that indicates, in a simple manner and with a high degree of reliability, whether the locked object provided with this locking device has already been opened.

According to regulations existing in many countries, and in the EU, the consumers of products such as, in particular, beverages and cosmetic products in bottles and containers are to be provided with the assurance that the correspondingly packaged product has never been opened since it was produced and packaged.

In the prior art, controllable seals of this sort often have a safety mechanism against accidental opening, and also enable detection, upon close inspection, of whether the seal has already been opened. However, this control function is often faulty, and the detection is often not possible without very close examination.

Thus, for example, in order to indicate manipulation of a container some locking devices use perforated lower collar areas of a locking cap made of metal or plastic, in which in order to remove the cap the collar area must be partially or completely detached from the cap. However, in particular if the collar remains on the cap and need only be broken, close inspection is required in order to discover that the container has already been opened.

If, on the other hand, the collar remains completely on the container, then, in particular in the case of metal collars, the perforation results in sharp edges that can result in injury, or that create problems when recycling the container, for example in the case of a bottle that is returnable for refund.

SUMMARY OF THE INVENTION

The present invention is therefore based on the object of creating a locking device that indicates, in a simple manner and with a high degree of reliability, whether the locked object provided with this device has already been opened.

The locking device according to the present invention has at least one first segment, as well as at least one second segment situated so as to be movable relative to the first segment, the at least one first segment and the at least one second segment being capable of assuming at least one first and at least one second position relative to one another, and at least one segment having at least one indicator area that can be essentially permanently modified in at least one physically perceivable property.

According to the present invention, the essentially permanent modification of the physically perceivable property of an indicator area is effected immediately in that the movement required in order to open and/or close the locking device moves the position of at least one first segment relative to at least one second segment at least temporarily from the first position into the second position.

In a preferred development of the device according to the present invention, the physically perceivable property of the indicator area is chosen from a group including, in particular but not exclusively, color, transparency, reflectivity, and brightness.

In a preferred specific embodiment, at least two locking components are provided that are rigid and that are capable of being moved relative to one another. Preferably, at least two locking components are connected to one another by a connecting device so as to be capable of movement relative to one another.

In a preferred specific embodiment, at least two locking components have shapes selected from a group that includes, in particular but not exclusively, cylindrical, spherical, conical, elliptical, annular, and cubical shapes.

In the context of the present invention, locking components or caps include essentially rigid bodies, preferably each having at least one opening, that are matched to one another geometrically in such a way that preferably a smaller body can be positioned inside a correspondingly larger body through the opening. Preferably, two locking components nested with one another in this way form the main components of the locking device according to the present invention.

As a connecting device, in the context of the present invention a device is understood that connects at least two locking components as described above that are preferably nested with one another, preferably so as to be capable of being moved in such a way that the movement is essentially guided in its direction and in its maximum travel length by the connecting device. These components can be for example collars, rods, or fitted rings on one or more locking components that are matched essentially to the circumference, perforations, or recesses of at least one other locking component, so that the locking components fitted therein can for example slide only along a peripheral hole or in a recess.

In another preferred specific embodiment, at least two locking components are realized as at least one outer cap and at least one inner cap. Preferably, at least one inner cap is positioned at least partly inside at least one outer cap, preferably essentially concentrically.

In a preferred development of the device according to the present invention, at least one outer cap has at least one transparent segment that is situated such that at least one segment of at least one inner cap is visible through it.

In another preferred specific embodiment, at least one inner cap has at least one first locking engagement device such as, in particular but not exclusively, threadings, fitted and/or flange rings and/or sealing rings, permitting a detachable engagement between the inner cap and at least one correspondingly matched second locking engagement device on the locked object.

In a preferred development of the device according to the present invention, on at least one outer and/or inner cap there is provided at least one guide device such as, in particular but not exclusively, a collar, a rail, a ring, or the like, in such a way that at least one outer cap and at least one inner cap can be moved essentially only along a preferred direction towards one another.

In a preferred development of the device according to the present invention, on at least one of the at least two locking components there is provided at least one snap device that, after the moving of at least one first segment into the second position relative to at least one second segment, fixes the two locking components essentially in relation to one another, in particular through the action of a non-positive and/or positive connection or of a resistance that is to be overcome.

In a preferred specific embodiment, the movable situation of the at least two locking components takes place in such a way that relative movements between these two locking components are enabled that are selected from a group including radial rotation, axial and lateral displacement, lateral deformation, and axial tilting with respect to the common geometrical longitudinal axis of the locking components.

In a preferred development of the device according to the present invention, at least one first segment is provided at least partially with a colored layer that can be at least partially removed through mechanical action, and at least one second segment has at least one shaving device that acts at least at a point in time during the movement into the second position, and acts at least partly mechanically on the colored layer. Preferably, at least one first segment has, underneath its colored layer, a different color.

As a shaving device, in the context of the present invention a shaped element preferably situated on a locking component, such as for example a longitudinal or transverse web, is understood, which, during the movement necessary for opening, moves with a locking component relative to another locking component, and, via mechanical action of the shaped element on at least one part of a removable colored layer of the second locking component, shaves off this colored layer at least partially.

In a preferred development of the device according to the present invention, at least one first segment is provided underneath its colored layer with images, signs, logos, inscriptions, or combinations thereof.

In a preferred specific embodiment, for the at least one shaving device a shape is provided that is selected from a group including bar shapes, helical shapes, star shapes, spiral shapes, and/or annular shapes.

In a preferred development of the device according to the present invention, on at least one first segment there is provided at least one device that is capable of being turned in relation to an essentially outward-facing side of the locking device, said turnable device having at least one first and at least one second side, the sides differing from one another in at least one physically perceivable property.

In a preferred development of the device according to the present invention, at least one turnable device is connected to at least one first and at least one second segment, such that at least at a point in time during the movement of the first segment and second segment connected to the turnable device from their first into their second position relative to one another, essentially the respective other side of the turnable device faces an essentially outward-facing side of the locking device.

In a preferred development of the device according to the present invention, at least one second segment has at least one turning device that, at least at a point in time during the movement into the second position, acts at least partly mechanically on the turnable device in such a way that essentially the respective other side of the turnable device faces an essentially outward-facing side of the locking device.

In a preferred specific embodiment, shapes are provided for the turning device that are selected from a group including bar shapes, star shapes, and/or annular shapes.

In a preferred development of the device according to the present invention, at least one side of at least one turnable device is provided with images, signs, logos, inscriptions, or combinations thereof.

In a preferred development of the device according to the present invention, at least one first segment has an indicator area made of a material that, given a predetermined action, changes in at least one of its physically perceivable properties, and at least one second segment has at least one acting device that acts at least partially in a predetermined manner on the indicator area at least at a point in time during the movement into the second position.

In a preferred development of the device according to the present invention, the action of the acting device is mechanical, thermal, chemical, electrostatic, and/or a combination of these.

In a preferred specific embodiment, at least one first segment has at least one gas-sensitive indicator area made of a material that changes at least one of its physically perceivable properties under the influence of at least one reaction gas, preferably one contained in the atmosphere, such as, in particular but not exclusively, oxygen.

In a preferred development of the device according to the present invention, in the first position the gas-sensitive indicator area is essentially limited in gas-tight fashion against its surrounding environment, and has no contact with the reaction gas.

In a preferred specific embodiment, in the second position the gas-tight limiting of the gas-sensitive indicator area from its environment is removed, and the indicator area comes at least partially into contact with a part of the reaction gas present in its surrounding environment.

In a preferred development of the device according to the present invention, a safety device is provided that prevents an unintentional moving of at least one first segment relative to at least one second segment from the first into the second position, through, in particular but not exclusively, a non-positive and/or positive securing, a resistance that is to be overcome, or a predetermined breaking point.

In a preferred development of the device according to the present invention, a fixing device is provided that, after the moving of at least one first segment into the second position in relation to at least one second segment, brings about a rigidifying of at least one segment in this position through, in particular but not exclusively, the action of a non-positive and/or positive securing, or of a resistance that is to be overcome.

BRIEF DESCRIPTION OF THE DRAWINGS

Additional advantages and specific embodiments of the present invention result from the accompanying drawings.

DETAILED DESCRIPTION

Figure 1:
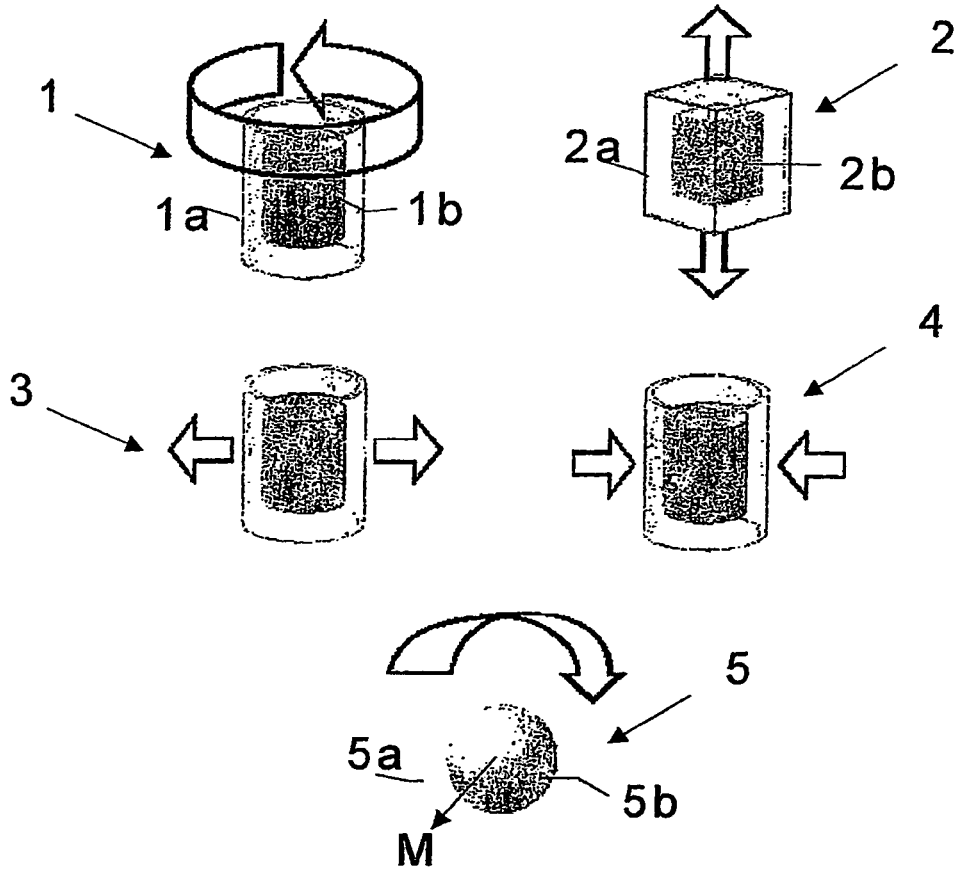
FIG. 1 is a perspective view of possible relative movements of two locking components.

Reference character 1 in FIG. 1 designates an exemplary embodiment in which two locking components are formed by an outer, essentially cylindrical, cap 1*a*, and a smaller inner, likewise essentially cylindrical cap 1*b*, inner cap 1*b* being positioned essentially concentrically inside outer cap 1*a*.

The relative movement required according to the present invention of at least two segments here takes place through the radial rotation of outer cap 1*a* in relation to inner cap 1*b*. Here it is possible for the caps 1*a*, 1*b* to be two separate components guided in their rotational movement—only as an example—via a collar (not shown) or ring that is correspondingly realized on the lower side of outer cap 1*a*.

On the other hand, this collar can also be realized in such a way that it engages in a correspondingly matched bulge on the lower side of inner cap 1*b*, which correspondingly represents a preferred development of a connecting device. In an exemplary embodiment fashioned in this way, this is indeed a component coupled in a movable fashion, but is only one component.

Reference character 2 designates another exemplary embodiment having two essentially cubical caps 2*a*, 2*b*, nested in one another in the manner of the exemplary embodiment shown in FIG. 1, the point of intersection of the geometrical spatial diagonals of caps 2*a*, 2*b* being essentially identical. In this example, in particular a relative movement between caps 2*a*, 2*b* is conceivable that is introduced by axial pressure or pulling along the common geometrical center longitudinal axis of the two cubical caps 2*a*, 2*b*, and that moves outer cap 2*a* axially downward or upward in relation to inner cap 2*b*.

Reference character 3 designates a device according to the present invention corresponding to a locking device 1, but here the arrows pointing outward at the right and at the left from the longitudinal sides indicate that here the movement of cylindrical caps 1*a*, 1*b* relative to one another that is necessary to trigger the color identification of the first opening is introduced by lateral pulling, whereby outer cap 1*a* moves laterally to the right or to the left in relation to inner cap 1*b*. The lateral pulling can also be effected indirectly by pressing in a direction essentially perpendicular to the jacket side of outer cap 1*a*.

Locking device 4 is another exemplary embodiment having two cylindrical caps 1*a*, 1*b* as locking components. Here, however, the inward-pointing arrows at the longitudinal sides indicate that the relative movement according to the present invention takes place through lateral crimping, which effects a deformation in the form of an inward-directed denting of the jacket side of outer cap 1*a*, which as a result moves relative to the jacket side of inner cap 1*b*.

Reference character 5 designates another exemplary embodiment, schematically depicted as having two essentially hemispherical concentrically nested caps 5*a*, 5*b* that act as locking components according to the present invention. In this exemplary embodiment, the color change of the locking device according to the present invention is triggered in that outer cap 5*a* is axially tilted in relation to inner cap 5*b* in relation to the common geometrical center axis M extending from the plane of the page; i.e., the geometrical center vertical of the circular opening cross-section of outer hemispherical cap 5*a* is inclined by a particular angle in relation to center axis M.

In general, arbitrary combinations of the above-described relative movements between the locking components, or the outer and inner caps, are also within the scope of the present invention, such as for example an axial pressing and displacement of the caps up to a stop, followed by a radial rotation of the caps. Such combination movements have the advantage of making it more difficult for children to open containers whose contents are hazardous. Preferably, a change of the relative positions of the segments according to the present invention takes place only upon one of the relative movements.

Figure 2:
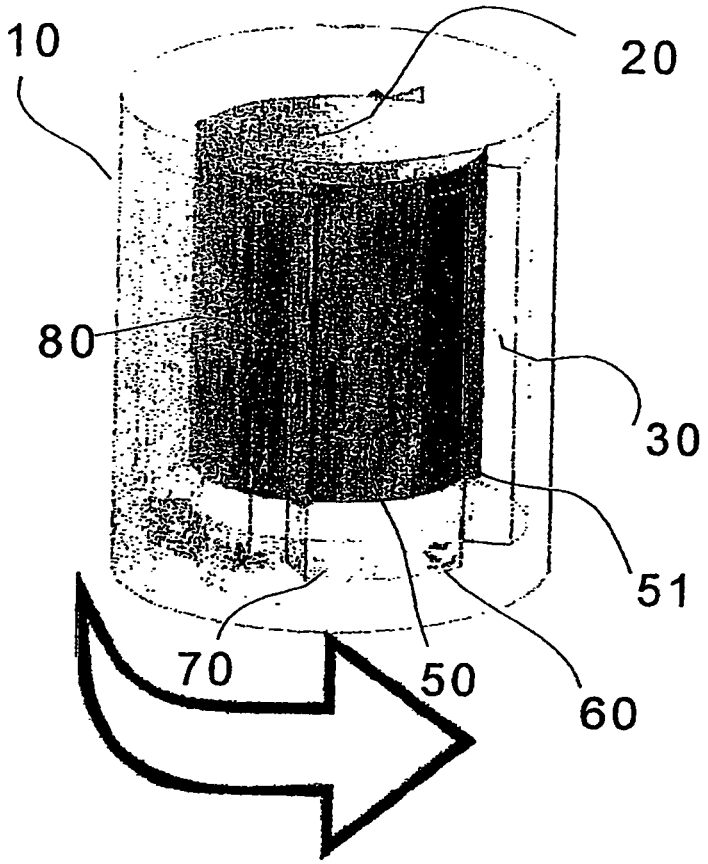
FIG. 2 is a perspective view of an exemplary embodiment of the locking device according to the present invention with shaving devices.

On the basis of FIG. 2, an exemplary embodiment is described in detail in which for the color identification, shaving devices 30 and removable color layer 50 are provided. The exemplary embodiment has an essentially cylindrical outer cap 10 as a first locking component, as well as the smaller, likewise essentially cylindrical cap 20 positioned essentially concentrically therein as a second locking component.

The outer lateral jacket surface of inner cap 20 is provided with a removable color layer 50 having a predetermined color. On the periphery of the inner cylindrical jacket surface of outer cap 10, four shaving devices 30 are situated with essentially uniform spacing from one another. Any number of shaving devices 30 distributed over the periphery are suitable for this purpose, but their number is preferably between one and ten. Preferably, these devices are distributed uniformly over the periphery; however, special distributions are also conceivable, for example in order to shave shapes, images, logos, or the like from the colored layer.

These devices are realized as right-angled profile webs, each situated parallel to the geometrical center axis of the two caps, and having a triangular cross-section, whose diagonally opposite edges face the inner jacket surface of outer cap 10, and whose center edge 80, extending into the interior of outer cap 10, stands in mechanical engagement with the outer jacket surface of inner cap 20. Shaving devices 30 preferably have, as shown, a length that corresponds essentially to the height of inner cap 20; however, shorter shaving devices are also conceivable that correspondingly move over a part of the outer jacket surface of inner cap 20 during opening. Simple webs, which shave with only one edge, are also suitable as shaving devices, as are webs having a sawtooth-shaped, parallelogram-shaped, S-shaped, or Z-shaped cross-section.

If outer cap 10 is radially rotated in relation to inner cap 20, center edge 80 of shaving device 30 shaves in the peripheral direction of the outer jacket side of inner cap 20 in such a way that colored layer 50, which is preferably easily removed, is worn away, and the outer side 51 of inner cap 20, which preferably has at least partially a different color due to the wearing away, can be recognized through the preferably at least partially transparent outer cap 10.

Preferably, the pigment residue 60 from the worn-away colored layer 50 is caught by collar 70 formed on the lower side of outer cap 10, said collar extending in the radial direction essentially perpendicular to the jacket surface of outer cap 10 in a lower area of cap 10, from the inside of cap 10 up to the outside of inner cap 20.

Collar 70 additionally performs the function of guiding the relative movement, i.e., the radial rotation of the outer cap in relation to inner cap 20, in the sense of a guide device of a preferred development. It is additionally possible for collar 70 to stand in non-positive or positive engagement with a correspondingly matched bulge (not shown) on the lower outer side of the inner cap, collar and bulge together forming a preferred connecting device between the two locking components 10 and 20.

Inner cap 20 preferably has on its inner side threadings (not shown) that engage in corresponding threadings on the object that is to be locked.

In order to prevent the two caps 10 and 20 from being moved relative to one another accidentally and not for the purpose of opening the locked object, a predetermined breaking point (not shown) can for example be provided on the lower collar 70, between the inner and outer cap, that must first be intentionally broken in order to enable the two caps 10 and 20 to be rotated radially relative to one another.

However, this can also be brought about in that, for example, the center edges 80 of shaving devices 30 must overcome one or more webs or raised parts provided on the outer sides of inner cap 20, parallel to the geometrical center axis of caps 10, 20.

These webs or raised parts are preferably situated such that in the unopened initial state the center edges 80 of shaving devices 30 essentially lie against a side of the raised parts or webs, and, for the opening through the rotation of shaving devices 30 together with the outer cap, must be moved over the webs or raised parts on the outer side of the inner cap, which represents a certain resistance that is to be overcome. The webs or raised parts perform the function of a safety device in the sense of a preferred development. A gluing of shaving devices 30 to the outer surface of inner cap 20, said gluing being detachable with a certain degree of resistance, can also act as such a safety device.

Preferably, through a snap device (not shown) outer cap 10 enters into essentially rotationally fixed engagement with inner cap 20, after it has been rotated by a predetermined angle in relation to inner cap 20, whereby at least a part of colored layer 50 is removed that can clearly be recognized through transparent outer cap 10. This has the effect that subsequently both caps can together be rotated off of the locked container through further rotation, with the aid of the threadings (not visible here) provided on the inside of inner cap 20 in the described example.

Preferably, outer cap 10 comes into essentially fixed engagement with inner cap 20 in that, in a manner similar to the safety device described above that prevents unintentional rotation of the inner and outer cap in relation to one another, for example the center edges 80 of shaving devices 30 come into contact with additional, preferably higher, web-shaped or otherwise shaped raised parts (not shown) on the outside of inner cap 20, preventing further rotation of the caps.

Preferably, just before the stop webs that prevent a further rotation between the inner and outer cap, the center edges 80 of shaving devices 30 must overcome additional webs that are less highly raised or that are also fashioned in a barbed manner, having a triangular transverse profile, on the outside of inner cap 20, so that an essentially non-positive and/or positive connection arises between the outer and inner cap, and both caps remain in a fixed position relative to one another even when the locked object is closed again by rotation in the opposite radial direction. Such interlocking webs are also conceivable in the lower collar area of the two caps.

It is preferred for the outside of inner cap 20 not only to have a color differing from that of the colored layer, but to be provided with images, signs, logos, inscriptions, or combinations thereof.

Figure 3:
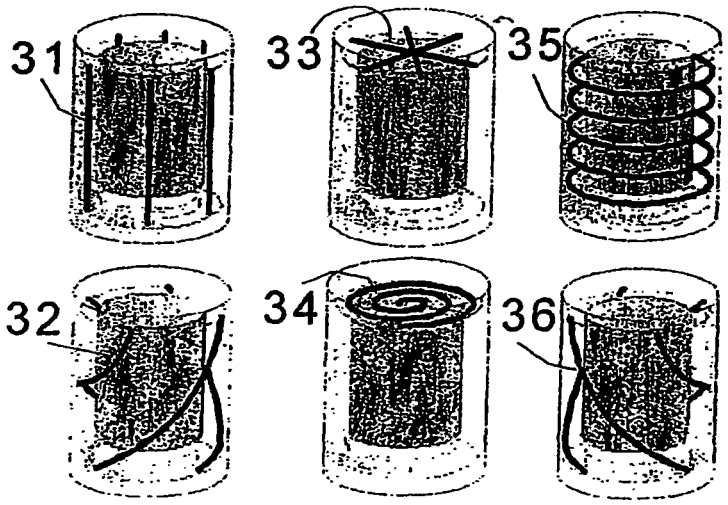
FIG. 3 is perspective views of various exemplary embodiments of the locking device according to the present invention with various shaving devices.

FIG. 3 shows a series of alternative situations and shapes of the shaving devices. Depending on the type of shaving desired, these can be correspondingly matched to the side that is provided with a colored layer, or can be matched to the relative movement of the caps, which are cylindrical in all examples. Reference character 31 designates, for example, a locking device that has, in comparison to the locking device shown in FIG. 2, additional bar-shaped shaving devices.

In contrast, reference character 32 designates helical shaving devices that can be fashioned similar to a threading, having one or more threads. Here, the color is removed obliquely downwards by the rotation of outer cap 10 in relation to the inner cap, in the case of a counterclockwise opening rotation.

Reference characters 33 and 34 designate star-shaped or spiral-shaped shaving devices that remove a colored layer from the end surface of the inner cap. In the case of shaving devices 33 the shaving takes place in the peripheral direction, and in the case of shaving devices 34 the shaving takes place in the radial direction. The spiral-shaped shaving device has the additional advantage that during rotation the pigment residue is transported outward.

Reference characters 35 and 36 designate two additional cylindrical cap seals, the movement necessary to remove the locking device from the locked object being introduced by axial pulling or pressing. In this example, annular shaving devices 35 remove the color from the outside of inner cap 20 in the axial direction. Helical shaving devices 36 are also suitable where the color is removed obliquely downwards with stroke movements or pulling movements.

Figure 4:
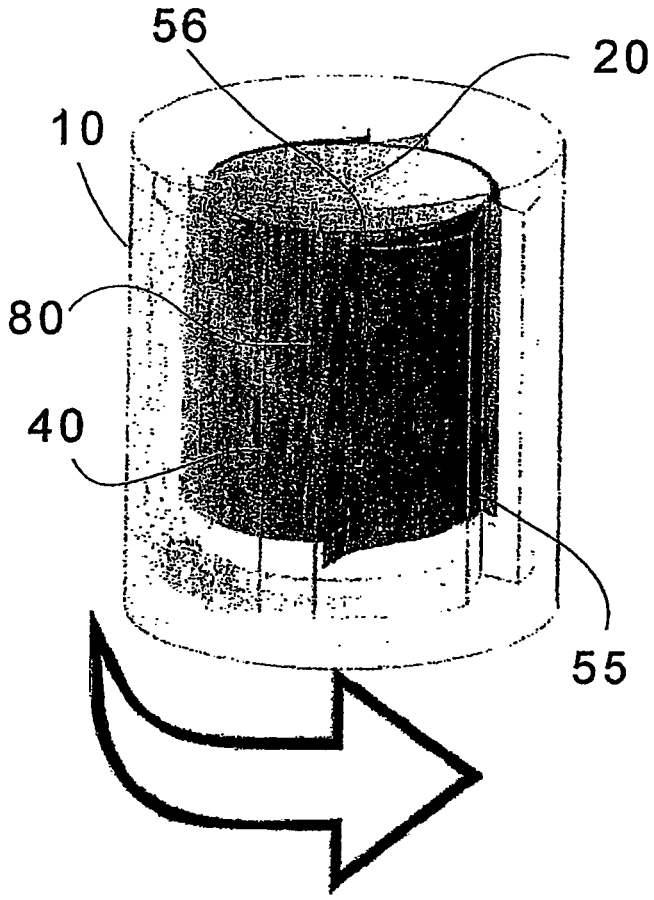
FIG. 4 is a perspective view of an exemplary embodiment of the locking device according to the present invention with turning devices.

FIG. 4 shows an exemplary embodiment of the locking device according to the present invention in which turnable devices and turning devices in the sense of the present invention are used. As in the exemplary embodiment shown in FIG. 3, the locking device is again made up essentially of an essentially cylindrical outer cap 10 in which a likewise cylindrical inner cap 20 is situated essentially concentrically.

In this example, the outer cylinder jacket surface of inner cap 20 is essentially covered by four turnable foils 55, forming a turnable device in the sense of the present invention. A longitudinal side of the foil parallel to the geometrical center axis of the caps lies against the outer jacket surface of inner cap 20, and only one side of a respective turning film 55 is essentially connected fixedly with the outer jacket surface of inner cap 20, each fastened side of a turning foil 55 directly abutting the adjoining side of the adjacent turning foil 55.

In the exemplary embodiment, four turning devices 40 are situated on the inner jacket surface of outer cap 10, essentially with a uniform distance from one another on the periphery. Turning devices 40 in the sense of the present invention are here formed by webs that have a sawtooth-shaped cross-section and that extend obliquely from the inner jacket surface of the outer cap into the interior, and whose edge 80 facing away from the inner jacket surface of outer cap 10 lies against the outer jacket surface of inner cap 20.

Similar to shaving devices 30 in the exemplary embodiment shown in FIG. 3, during counterclockwise rotation in the peripheral direction web-type turning devices 40 engage, with their edge 80 that lies obliquely against the jacket surface of inner cap 20, under turning films 55, which lie only against the outer jacket surface of inner cap 20, in such a way that edges 80, lying against the inner cap of turning devices 40, slide under turning foil 55, and upon further rotation press the films radially outward in the clockwise direction, finally carrying the free end of turning foil 55 along further in the peripheral direction.

Here, the rotation of outer cap 10 takes place at least until free ends 56 of turning foil 55 are carried along beyond the point at which the same turning foil is fastened to the inner cap, and also beyond this point, so that finally the sides of turning films 55 that at first face the outer jacket surface of inner cap 20 are oriented outwards. These preferably have a color that is clearly different from the initially outward-pointing sides of turning films 55, which can be seen from the outside through the at least partly transparent jacket side of the outer cap.

Here as well, in addition or instead, images, signs, logos, inscriptions, or combinations thereof can additionally be provided on the initially covered sides of the turning films.

Preferably, as described above, in the exemplary embodiment according to FIG. 4 web-type snap devices are also provided on the outer jacket surface of inner cap 20 (not shown), which, after the turning of the films, prevent the caps from being able to be rotated further in the same direction or rotated back, so that the films could possibly be turned back.

Figure 5:
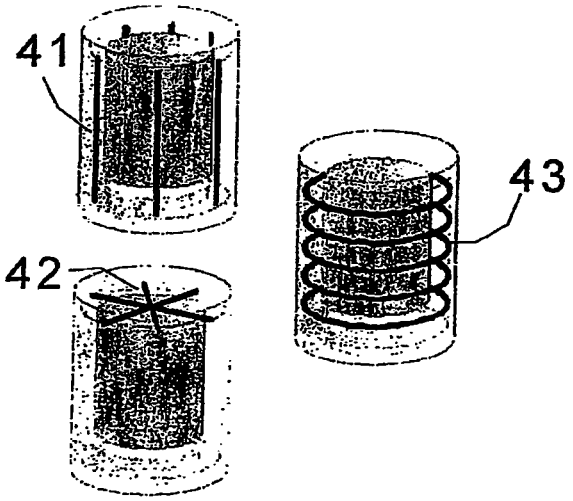
FIG. 5 is perspective views of various exemplary embodiments of the locking device according to the present invention with various turning devices.

FIG. 5 shows a series of additional locking devices according to the present invention having alternative situations of the turning devices. For example, similar to the situation shown in FIG. 4, reference character 41 designates additional bar-shaped turning devices that are offset in the peripheral direction. Reference character 42 designates star-shaped turning devices that, given radial rotation of the outer cap, turn films having the shape of the arc of a circle that are situated on the star surface. In the example of the annular turning devices 43, the turning of the films takes place through vertical pulling or pressing of the outer cap. For this purpose, the films are preferably slit, or have at least one elastic segment, in order to facilitate a turning.

When there is turning via a pulling or pressing movement, it can happen, in particular in the case of the pulling movement, that the opening of the lock also takes place through the pulling movement. However, it is also possible that after outer cap 10 has been brought into a final position in relation to the inner cap by a pulling or pressing movement, a rotating movement is enabled for the actual opening of the locking device. Differing from the exemplary embodiments described above, it is also possible for the shaving devices situated on the inside of the outer cap to be situated on the outside of the inner cap, and, conversely, for the color layer to be provided on the inside of an outer cap that is at least partially transparent. It is likewise conceivable that in the locking device according to FIG. 4 the turning devices are situated on the outside of the inner cap and the turning films are situated on the transparent inside of the outer cap.

The invention claimed is:

1. A locking device for locking an object comprising:

an inner cap having a first locking engagement device including one of threadings, fitted rings, flange rings and sealing rings, permitting a detachable engagement between the inner cap and a correspondingly matched second locking engagement device on the object being locked, an outer cap having a transparent portion that is situated so that at least a portion of the inner cap is visible through it, said inner cap and said outer cap being two substantially rigid locking components; and the inner cap and the outer cap being capable of assuming at least a first position and a second position relative to one another such that a movement required to open the locking device immediately moves the position of the inner cap relative to the outer cap from the first position to the second position, wherein the inner cap includes an indicator area that is permanently modified in at least one physically perceivable property, the permanent modification of the at least one physically perceivable property of said inner cap being affected by the movement to open the locking device and being at least partially viewable through the transparent portion of the outer cap, wherein at least one of said inner and outer caps includes at least one snap device that, after moving the inner cap into the second position relative to the outer cap, fixes the inner and outer caps substantially in relation to one another through the action of one of a non-positive connection, a positive connection or a resistance that is to be overcome such that the inner and outer caps remain in the second position relative to one another even when closing the locking device again.

2. The device as recited in claim 1, wherein the physically perceivable property is chosen from a group including, in particular but not exclusively, color, transparency, reflectivity, and brightness.

3. The device as recited in claim 1, wherein the inner and outer caps are connected via a connecting device so as to be capable of being moved from the first position to the second position.

4. The device as recited in claim 1, wherein the inner and outer caps have shapes selected from a group that includes, in particular but not exclusively, cylindrical, spherical, conical, elliptical, annular, and cubical shapes.

5. The device as recited in claim 1, wherein the inner cap is positioned at least partly inside the outer cap, preferably substantially concentrically.

6. The device as recited in claim 1, wherein on the outer cap and the inner cap there is provided at least one guide device including one of a collar, a rail and a ring, in such a way that the outer cap and the inner cap can be moved substantially only along a preferred direction towards one another.

7. The device as recited in claim 1, wherein the inner and outer caps are moved in such a way that relative movements between inner and outer caps are enabled when the movements are selected from a group including radial rotation, axial and lateral displacement, lateral deformation, and axial tilting with respect to the common geometrical longitudinal axis of the caps.

8. The device as recited in claim 1, wherein the inner cap is provided at least partially with a colored layer that can be at least partially removed through mechanical action, and the outer cap has at least one shaving device that acts at least at a point in time during the movement into the second position and that acts at least partly mechanically on the colored layer.

9. The device as recited in claim 8, wherein the inner cap has a different color underneath its colored layer.

10. The device as recited in claim 8, wherein said inner cap is provided underneath its colored layer with images, signs, logos, inscriptions, or combinations thereof.

11. The device as recited in claim 8, further including for the at least one shaving device, shapes that are selected from a group including bar shapes, helical shapes, star shapes, spiral shapes, and/or annular shapes.

12. The device as recited in claim 1, wherein on said inner cap there is provided at least one turnable device that is capable of being turned in relation to a substantially outward-facing side of the locking device, said turnable device having a first side and a second side, the first and second sides differing from one another in at least one physically perceivable property.

13. The device as recited in claim 12, wherein the at least one turnable device is connected to said inner cap and said outer cap, and, at least at a point in time during the movement from the first into the second position relative to one another, substantially the respective other side of the turnable device faces a substantially outward-facing side of the locking device.

14. The device as recited in claim 12, wherein said outer cap has at least one turning device that, at least at a point in time during the movement into the second position, acts at least partly mechanically on at least one turnable device in such a way that substantially the respective other side of the turnable device faces an substantially outward-facing side of the locking device.

15. The device as recited in claim 14, wherein shapes are provided for the turning devices that are selected from a group including bar shapes, star shapes, and annular shapes.

16. The device as recited in claim 12, wherein at least one side of at least one turnable device is provided with images, signs, logos, inscriptions, or combinations thereof.

17. The device as recited in claim 1, wherein said inner cap has an indicator area made of a material that, given a predetermined action, changes in at least one of its physically perceivable properties, and said outer cap has an acting device that acts at least partially in a predetermined manner on the indicator area at least at a point in time during the movement into the second position.

18. The device as recited in claim 17, wherein the action of the acting device is at least one of a mechanical action, thermal action, chemical action, electrostatic action, a combination of these actions.

19. The device as recited in claim 1, wherein said inner cap has a gas-sensitive indicator area made of a material that changes at least one of its physically perceivable properties under the influence of at least one reaction gas, preferably one contained in the atmosphere such as, in particular but not exclusively, oxygen.

20. The device as recited in claim 19, wherein in the first position, the gas-sensitive indicator area is limited in substantially gas-tight fashion against its surrounding environment, and has no contact with the reaction gas.

21. The device as recited in claim 20, wherein in the second position, the gas-tight limiting of the gas-sensitive indicator area against its surrounding environment is removed, and the indicator area comes at least partly into contact with a part of the reaction gas present in its surrounding environment.

22. The device as recited in claim 1, further including a safety device that prevents an unintentional moving of the inner cap or the outer cap into the second position, through, in particular but not exclusively, a non-positive and/or positive securing, a resistance that is to be overcome, or a predetermined breaking point.

* * * * *